United States Patent [19]

Graham

[11] Patent Number: 4,988,005

[45] Date of Patent: Jan. 29, 1991

[54] SIFTER

[76] Inventor: John T. Graham, P.O. Box 30004, Seattle, Wash. 98103-4004

[21] Appl. No.: 484,253

[22] Filed: Feb. 26, 1990

[51] Int. Cl.[5] ..... B07B 1/02

[52] U.S. Cl. ..... 209/419; 294/55

[58] Field of Search ..... 209/417, 418, 419; 294/9, 49, 55; 210/238, 470; 37/119, 120

[56] References Cited

U.S. PATENT DOCUMENTS

| | | | |
|---|---|---|---|
| 902,954 | 11/1908 | Felty | 209/419 |
| 3,188,668 | 6/1965 | Buckelew | 294/55 X |
| 4,491,357 | 1/1985 | Richards | 294/49 |

FOREIGN PATENT DOCUMENTS

| | | | |
|---|---|---|---|
| 190921 | 9/1936 | Switzerland | 209/419 |
| 337384 | 10/1930 | United Kingdom | 294/55 |
| 458041 | 12/1936 | United Kingdom | 209/419 |
| 1024334 | 3/1966 | United Kingdom | 294/49 |

*Primary Examiner*—Donald T. Hajec

[57] ABSTRACT

A hand tool for sifting soil in gardens, recovering buried articles and for other similar purposes where aggregate materials are to picked up and filtered to separate larger particles from smaller sized granules and powders. The device comprises essentially a "Y" shaped frame with the single end extended as a handle and with the forked end forming a triangular container open at the top with two sides similar, a straight, approximately flat blade supported at each end by the ends of the frame, the blade being the third side of the container, and a bottom planar surface perforated to allow the passage of materials. The tool can be made in different sizes and with different kinds of perforated surfaces, depending upon the purpose and size of particles to be retained.

1 Claim, 1 Drawing Sheet

SIFTER

SUMMARY OF THE INVENTION

This invention relates to any number of activities where manual picking up and separating coarse from fine paraticles are involved, particularly in the garden. In the past various types of sifting shovels, scoops, coal and ash sifters, have been proposed and produced usually for the purpose of separating ash from cinders. (U.S. Pat. Nos. 4,448,393 and 4,491,357). Utensils for sifting grain flours are commonly used for fine materials, but are not appropriate to situations of greater volume and weight. Sifting tools that are pulled like a rake (U.S. Pat. Nos. 4,828,690 and 3,979,146) accumulate granular material but suffer from awkwardness of operation when the coarse contents are lifted up off the ground. The art includes sifting shovels (U.S. Pat. No. 902,954) where tools maybe used either as sifters or as shovels, depending upon how the operator installs screen or solid surface panels. Screen-shovels used for placer mining have been proposed to pick up and separate coarse materials from fines and subsequently entrap gold particles in a filter lining of a container beneath the sifter. (U.S. Pat. No. 4,822,090). Swimming pool cleaning devices demonstrate framed screening tools (Buckelew, U.S. Pat. No. 3,188,668) with handles for removing debris from the bottom of pools; these have wheels and pivotally mounted blades to closely scrape a surface flat to the blade while picking up debris. Combination spades and sifters have been proposed for the garden where soil is first pried up and then transferred back from the surface of a shovel blade onto a screen sifter. (U.S. Pat. No. 3,851,763).

This invention relates most closely to this last activity, except that with this invention the blade works more like a shuffle-hoe sliding just beneath a surface than like a tool digging down and prying up material; also, the operator of the tool does not need to transfer material from a blade to a sifter. This tool was designed as a companion to a garden fork, spade or tiller to pick up a quantity of loosened soil, including weeds, bulbs, gravel and debris. Lifting the tool off the ground, the operator first tilts the tool backwards to cause the soil to spread widely across the perforated planar surface of screen and then shakes the tool laterally, in either a linear or circular motion, allowing gravity to pull fine particles through the screen. The operator determines the duration of this sifting action by visual inspection. When sufficient material has passed through the screen, the operator tilts the tool 45 degrees or so about the longitudinal axis of the handle to cause the retained materials to concentrate to one side of the triangular container. Then the operator raises the handle end of the tool relative to the container end and allows gravity to pull the retained materials down the valley so created into a bucket, wheelbarrow or to any location below the tool, as desired. Whereas this is one mode of operation, the tool may also be pushed like a shuffle hoe to slice under the top layer of soil, thereby loosening the soil. Thirdly, by rotating the tool 180 degrees about the longitudinal axis of the handle, the operator may use the tool like a flat-bar rake, pulling loose material toward the operator into a pile to be picked up and sifted or otherwise to be distributed for some useful purpose. With such pushing, pulling and sifting actions, soil surfaces may be cleaned by removing weeds, rocks and debris.

Significant to this invention is the continuity of structure linking the handle end of the frame with the forked container end to produce a direct flow of compressive and bending forces within the frame and therefore a lighter tool for a given strength. Effective use is dependent upon the tool being as light in weight as reasonable with sufficient strength.

This invention is not limited to use in the garden, but rather has its broadest application in picking up material from any surface regardless of whether that material is small enough to pass through the perforated plane. The tool can be made with different sizes and kinds of perforated surfaces, depending upon the purpose and size of particles to be retained.

DESCRIPTION OF THE INVENTION

Figure 1:
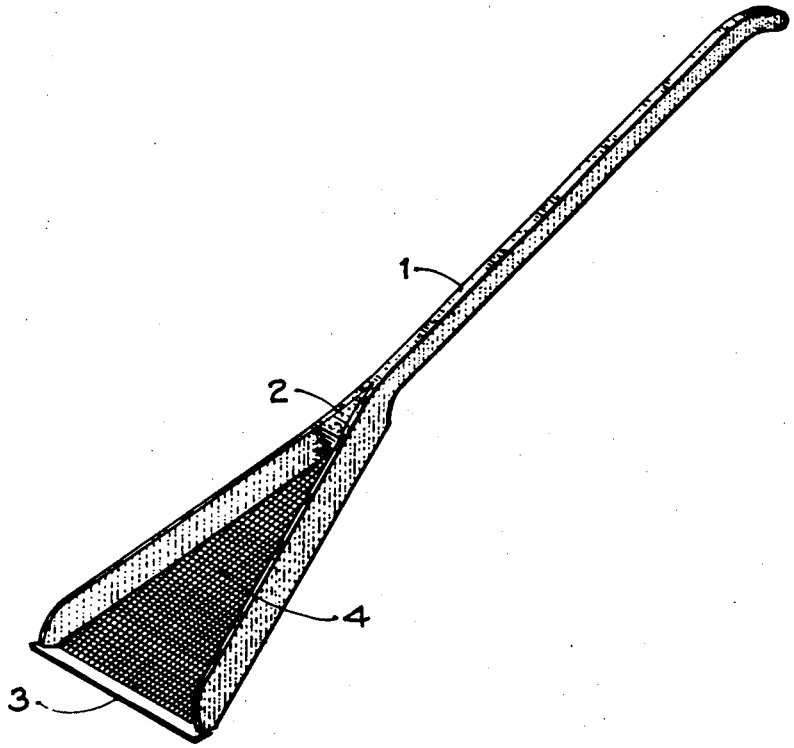
FIG. 1 is an orthagonal view of the first embodiment of the sifter in its entirety.
Figure 2:
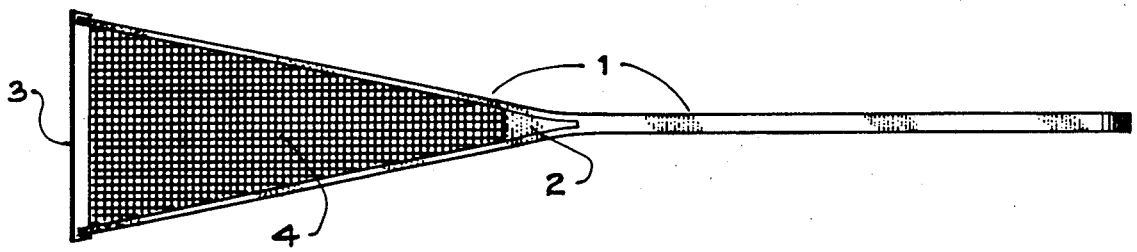
FIG. 2 is a top view of the apparatus of FIG. 1.
Figure 3:
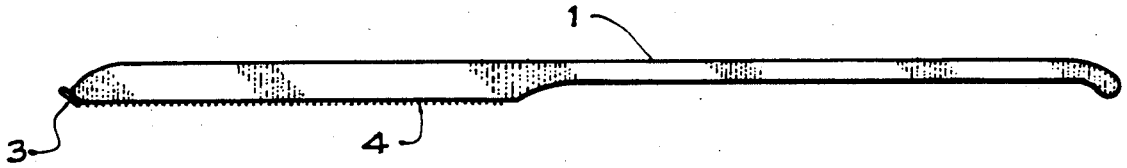
FIG. 3 is a left side view of the apparatus of FIG. 1.

With respect to FIGS. 1 through 3, the first embodiment includes a "Y" shaped frame 1 formed from hardwood approximately 56" long by 2" high by ⅞" thick, the "Y" being formed by slitting or cutting the wood for a certain distance to provide two cut sides and a remaining uncut portion, steam bending each side to the same angle in relation to the handle and reinforcing the joint where the two sides come together with wood block 2 glued in place. The remaining uncut portion forms a handle integral to the "Y" shaped frame. A metal blade 3 is attached to the end of each side of the "Y", forming the third side of a triangular container. In the first embodiment this blade is made from one piece of stainless steel sheet metal 12" long by 2" wide, bent over lengthwise for a rounded leading edge and provided with holes at each end for screw attachment to the wooden frame sides. The bent blade forms a channel into which one edge of an approximately triangular shaped perforated planar sifting screen 4 fits. The blade secures the screen and covers its sharp points. The other edges of the sifting screen are bent up 90 degrees and inserted ½" deep into continuous grooves cut into the wooden frame. They are held permanently in these grooves by adhesive, thereby concealing the sharp points of screen that otherwise might cause harm. The screen material of the first embodiment is ¼" by ¼" or ½" by ½" stainless steel welded wire fabric.

I claim:

1. A hand-held sifter tool for picking up, shaking and thereby sifting various types of aggregate matter ranging in size from coarse to fine, the tool comprising a generally "Y" shaped frame constructed substantially from a single straight piece of material formed by cutting the piece for a certain distance to provide two cut sides and a remaining uncut portion, bending each cut side and inserting a wedge block to reinforce the junction of the two cut sides with the remaining uncut portion, a blade fixed to and spanning between the end of each side of said "Y" shaped frame to form a contained area, an essentially triangular shaped perforated planar sifting screen, said perforated planar sifting screen being substantially supported on two sides thereof by the said "Y" shaped frame and on the third side by said blade, and said remaining uncut portion forming a handle integral to said "Y" shaped frame.

* * * * *